United States Patent [19]

Nakanishi

[11] 4,407,251

[45] Oct. 4, 1983

[54] FUEL-SUPPLY CONTROL SYSTEM

[75] Inventor: Keiichi Nakanishi, Yokohama, Japan

[73] Assignee: Nissan Motor Company, Ltd., Yokohama, Japan

[21] Appl. No.: 290,075

[22] Filed: Aug. 4, 1981

[30] Foreign Application Priority Data

Oct. 17, 1980 [JP] Japan ..... 55-144458

[51] Int. Cl.[3] ..... F02B 33/00; F02B 3/00

[52] U.S. Cl. ..... 123/472; 123/478; 123/490; 123/299

[58] Field of Search ..... 123/472, 478, 490, 299

[56] References Cited

U.S. PATENT DOCUMENTS

| | | | |
|---|---|---|---|
| 3,423,683 | 1/1969 | Kelsey et al. | 123/478 |
| 3,996,915 | 12/1976 | Demetrescu | 123/478 |
| 4,140,088 | 2/1979 | Vulpillieres | 123/478 |
| 4,176,627 | 12/1979 | Bassi | 123/478 |
| 4,196,702 | 4/1980 | Bowler | 123/478 |
| 4,235,205 | 11/1980 | Fukui | 123/472 |
| 4,257,376 | 3/1981 | Wen | 123/472 |
| 4,269,157 | 5/1981 | Fujishiro | 123/478 |
| 4,289,104 | 9/1981 | Takada | 123/472 |

FOREIGN PATENT DOCUMENTS 2012989 8/1979 United Kingdom .

*Primary Examiner*—Ronald B. Cox

*Attorney, Agent, or Firm*—Schwartz, Jeffery, Schwaab, Mack, Blumenthal & Koch

[57] ABSTRACT

A fuel supply control system for an engine includes a controller and a fuel supply line. In one embodiment, at least two parallel connected control valves are arranged in the line and are changed between open and closed states when energized by a drive signal. A sensor is provided for detecting an engine operating condition. A generator is provided for producing a random designation signal indicating any one of the different control valves. The controller produces a pulse train as the drive signal for the control valves in response to the output signal of the sensor so that the duty cycle of the pulse train varies with the engine operating condition. The controller distributes each pulse of the drive signal to any one of the control valves designated by the random designation signal of the generator to open the designated control valve so that any one of the control valves is opened in a random sequence. In a second embodiment, the number of the control valves may be one. In this case, each pulse-width of the drive signal changes at random within a relatively small range in response to the random signal from the generator.

17 Claims, 5 Drawing Figures

FUEL-SUPPLY CONTROL SYSTEM

BACKGROUND OF THE INVENTION

1. Field of the Invention

This invention relates to a fuel-supply control system for an internal combustion engine or a gas-turbine engine, wherein a fuel-metering valve or valves are driven by an electric pulse train so as to open intermittently while the duty cycle of the pulse train is varied with an engine operating condition so that the amount of fuel supplied to the engine responds to the engine operating condition.

2. Description of the Prior Art

In a well-known fuel-supply control system for an internal combustion engine, a fuel-metering valve controls the amount of fuel injected into the engine combustion chamber through a fuel-injection valve. When the control valve opens, fuel flows therethrough to be injected via the injection valve. Since a pressure regulator controls the fuel pressure so as to keep the fuel flow rate constant when the control valve opens, the amount of fuel injected is proportional to the time during which the control valve is open. Generally, the control valve is of the electrically-driven type opening when energized, and is driven by an electric pulse train so as to open periodically. Thus, the amount of fuel injected per a unit time, or the time-averaged fuel injection rate, depends on the duty cycle of the pulse train corresponding to the open time rate of the control valve. Meanwhile the duty cycle of the pulse train is varied with an engine operating condition, such as an engine required power (a power required from the engine) or an engine load so that the amount of fuel injected per a unit time responds to the engine operating condition.

When the engine is operated under constant conditions, such a fuel-supply control system may produce therein relatively large fuel pressure pulsations. Each opening of the control valve causes a pressure pulsation, which travels back and forth within the system like a wave until completely damped. In the above constant conditions, the control valve usually opens periodically at a constant frequency for a constant period, so that the fuel pressure pulsations may interfere with each other to form relatively large fuel pressure pulsations. These resultant large pressure waves severely disturb the regulated pressure of the fuel injected, thereby lowering the stability or the accuracy of the control of the amount of fuel injected per a unit time.

SUMMARY OF THE INVENTION

It is an object of the present invention to provide a fuel-supply control system for an engine, which can prevent the occurrence of relatively large fuel pressure pulsations and thus has adequate stability and accuracy of the fuel-supply control.

The fuel-supply control system for an engine of the present invention, includes a line in which fuel may flow to be supplied to the engine. At least two parallel connected control valves are arranged in the line and are opened when energized. A sensor is provided for detecting an engine operating condition. A generator is provided for producing such a random figure signal indicating any one of different figures in a random sequence that the number of the different figures is equal to that of the control valves to make the figures designate the control valves respectively. A controller is provided for producing a pulse train as a drive signal for the control valves in response to the output signal from the sensor so that the duty cycle of the pulse train varies with the engine operating condition. The controller distributes each pulse of the drive signal to the control valve designated by the random figure signal of the generator to open the designated control valve so that any one of the control valves is opened in a random sequence.

The number of the control valves may be one. In this case, each pulse-width of the drive signal in turn changes at random within a relatively small range in response to the random figure signal from the generator.

The above and other objects, features and advantages of the present invention will be apparent from the following description of preferred embodiments thereof, taken in conjunction with the drawings.

DESCRIPTION OF THE PREFERRED EMBODIMENTS

Figure 1:
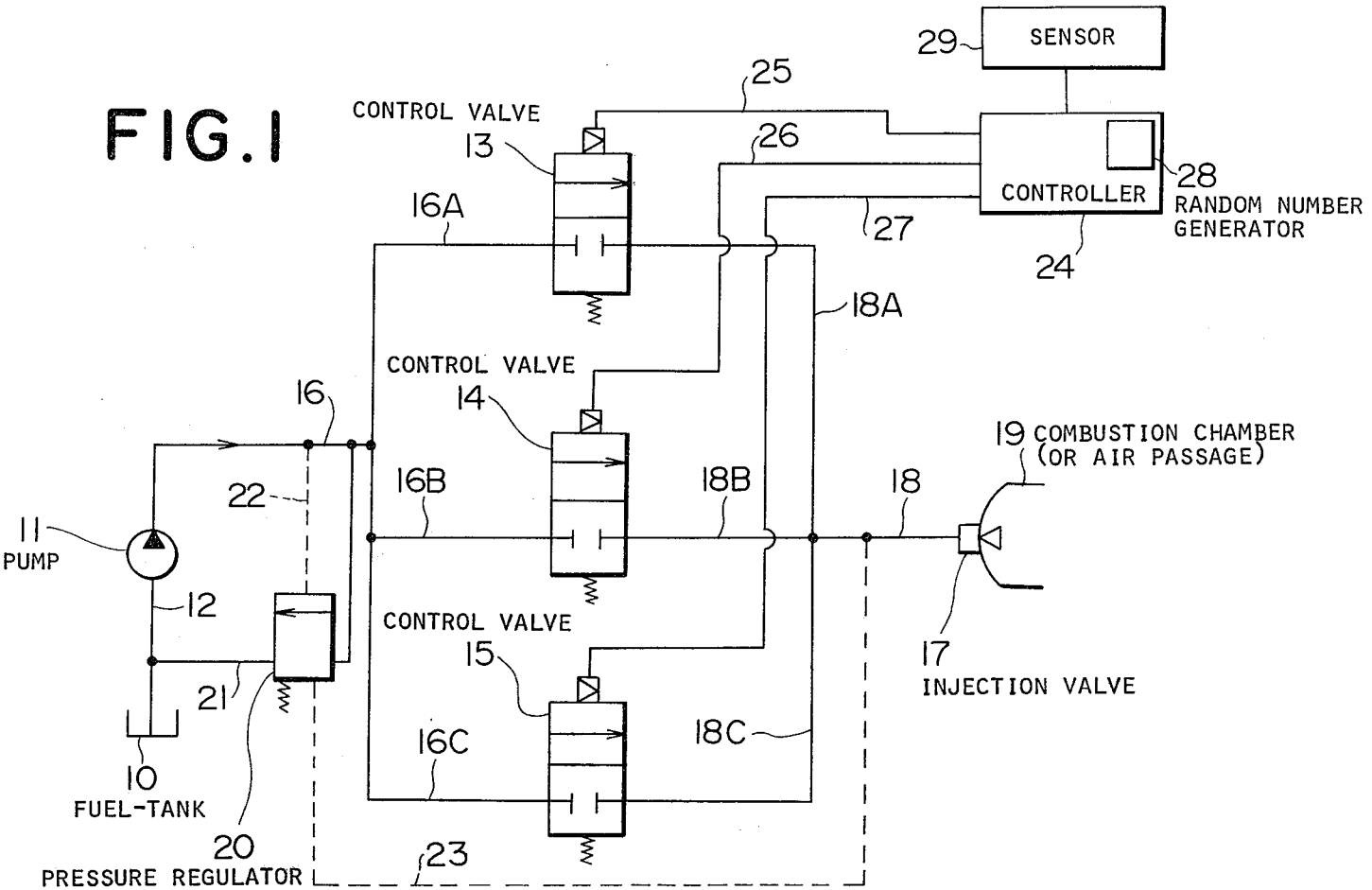
FIG. 1 is a diagrammatic view of a fuel-supply control system according to a first embodiment of the present invention.

With reference to FIG. 1, there is shown a fuel-supply control system according to a first embodiment of the present invention for an internal combustion engine or a gas-turbine engine, which has a fuel tank 10 and a fuel-feed pump 11. The pump 11 sucks fuel from the tank 10 through a line 12 and feeds the fuel to metering or control valves 13, 14 and 15 through a line 16. The line 16 branches into three branches 16A, 16B and 16C on its route corresponding to the number of the control valves 13, 14 and 15. The three branches of the line 16 are connected to the inlets of the control valves 13, 14 and 15 respectively, while the other end of the line 16 is connected to the outlet of the pump 11. The outlets of the control valves 13, 14 and 15 are connected to the inlet of an injection valve or nozzle 17 through a line 18. The line 18 is branched into three branches 18A, 18B and 18C in a similar way to the line 16. The three branches of the line 18 are connected to the outlets of the control valves 13, 14 and 15 respectively, while the other end of the line 18 is connected to the inlet of the injection valve 17. Thus the control valves 13, 14 and 15 are connected in a parallel configuration. The outlet of the injection valve 17 opens into an element 19, which is a combustion chamber when the engine is a gas-turbine or a Diesel engine, or an air intake passage leading to a combustion chamber when the engine is a gasoline engine.

Each of the control valves 13, 14 and 15 is so adapted to have substantially only two states, open and closed, or on and off. The injection valve 17 opens when the pressure across it exceeds a preset value. When one of the control valves 13, 14 and 15 opens, the pressurized fuel from the pump 11 is fed to the injection valve 17 and simultaneously the valve 17 opens to supply the fuel into the element 19, since the foregoing preset value of the opening of the injection valve 17 is so designed as to be less than the value of the pressure fed to the injection valve 17. Thus, when one of the control valves 13, 14 and 15 opens, fuel is supplied to the element 19 via the injection valve 17.

A pressure regulator 20 is provided for keeping the fuel pressure constant across the control valves 13, 14 and 15. The regulator 20 consists of a valve disposed in a line 21 connected at one end to the line 12 and at the other end to the line 16, in order to control the amount of fuel returning from the pump 11 to the tank 10. The regulator 20 has two different control inlets, one of which is connected to the line 16 through a line 22 to introduce therein the fuel pressure upstream of the control valves 13, 14 and 15 but downstream of the pump 11, and the other is connected to the line 18 through a line 23 to introduce therein the fuel pressure downstream of the control valves 13, 14 and 15 but upstream of the injection valve 17. The regulator 20 changes the degree of valve opening in response to the difference between the introduced fuel pressures upstream and downstream of the control valves 13, 14 and 15, or the pressure across them. When the pressure across the control valves exceeds a preset value, the regulator 20 increases the amount of fuel returning to the tank 10 to lower the pressure across the control valves to the preset value. When the pressure across the control valves drops below the preset value, the regulator 20 reduces the amount of fuel returning to raise the pressure to the preset value. Thus the regulator 20 maintains the pressure across the control valves 13, 14 and 15 at the preset value. Therefore, when one of the control valves 13, 14 and 15 opens, the flow rate of the fuel passing through the control valve is kept constant. To ensure this, the control valves 13, 14 and 15 are all designed similarly; the branches 16A, 16B and 16C consist of conduits, hoses, or passages whose cross-sectional areas are all equal to each other; and the branches 18A, 18B and 18C consist of conduits, hoses, or passages whose cross-sectional areas are all equal to each other. The amount of fuel supplied into the element 19 is thus proportional to the time during which a control valve is open.

Each of the metering valves 13, 14 and 15 is of the electrically-driven type, which is opened or switched from off to on when energized. A controller 24 operates the metering valves 13, 14 and 15 by providing drive signals to them through leads 25, 26 and 27 respectively. The controller 24 produces a pulse train control signal, each pulse of which is fed as a drive signal to any one of the metering valves 13, 14 and 15 at random to open them intermittently in an irregular sequence. Since the amount of fuel supplied to the element 19 is proportional to the open time of the metering valves 13, 14 and 15 (the time during which the metering valve opens), the amount of fuel supplied per a unit time or the time-averaged rate of fuel supplied responds to the duty cycle or the frequency and/or the pulse-width of the control signal produced by the controller 24. In general, while keeping the frequency of the control signal constant, the controller 24 changes the pulse-width of the control signal to vary the duty cycle thereof in response to an engine operating condition such as the engine required power (the power required from the engine), the engine load, or the intake air flow rate, which is detected electrically by a hereinafter described sensor 29. When the engine is operated under constant conditions, the control valves 13, 14 and 15 as a whole open periodically at a constant frequency for a constant period. However, since the control valves 13, 14 and 15 open in an irregular or random sequence, substantially no relatively large fuel pressure pulsations are caused by the opening and closing of the metering valves in the fuel supply system, in for example the lines 16 and 18. To ensure this, the control valves 13, 14 and 15 are disposed in the fuel supply system in different configurations from each other to avoid interferences between pressure pulsations each due to the opening and closing of the metering valves, which travel back and forth in the fuel supply system like waves while being damped with time, forming relatively large fuel pressure pulsations. In practice, the effective lengths of the branches 16A, 16B, and 16C, and/or those of the branches 18A, 18B, and 18C are different from each other. On the other hand, while keeping the pulse-width of the control signal constant, the controller 24 may change the frequency of the control signal to vary the duty cycle thereof in response to the engine operating condition.

The controller 24 incorporates therein a random number generator 28, which outputs a digital number or figure signal indicating at random any one of "0", "1", and "2" in terms of decimal numbers. Each pulse of the control signal produced by the controller 24 is distributed to any one of the control valves 13, 14 and 15 to open the same in response to the random number signal outputted by the generator 28. When the random number signal is "0", a pulse of the control signal is delivered to thecontrol valve 13. When the signal is "1", a pulse is delivered to the control valve 14. When the signal is "2", a pulse is delivered to the control valve 15. The generator 28 outputs the random number signal synchronously with the control signal produced by the controller 24. Thus, each pulse of the control signal is distributed to any one of the control valves 13, 14 and 15 at random, and consequently these control valves open in turn in a random or irregular sequence. Meanwhile, the sensor 29 is provided for detecting the engine required power, the engine load, or the air intake flow rate as an engine operating condition. For example, the controller 24 changes the pulse-width of the control signal in response to the output signal from the sensor 29 indicative of the engine required power. As the engine required power increases, the controller 24 widens the pulse-width of the control signal to increase the amount of fuel supplied per a unit time.

Figure 2:
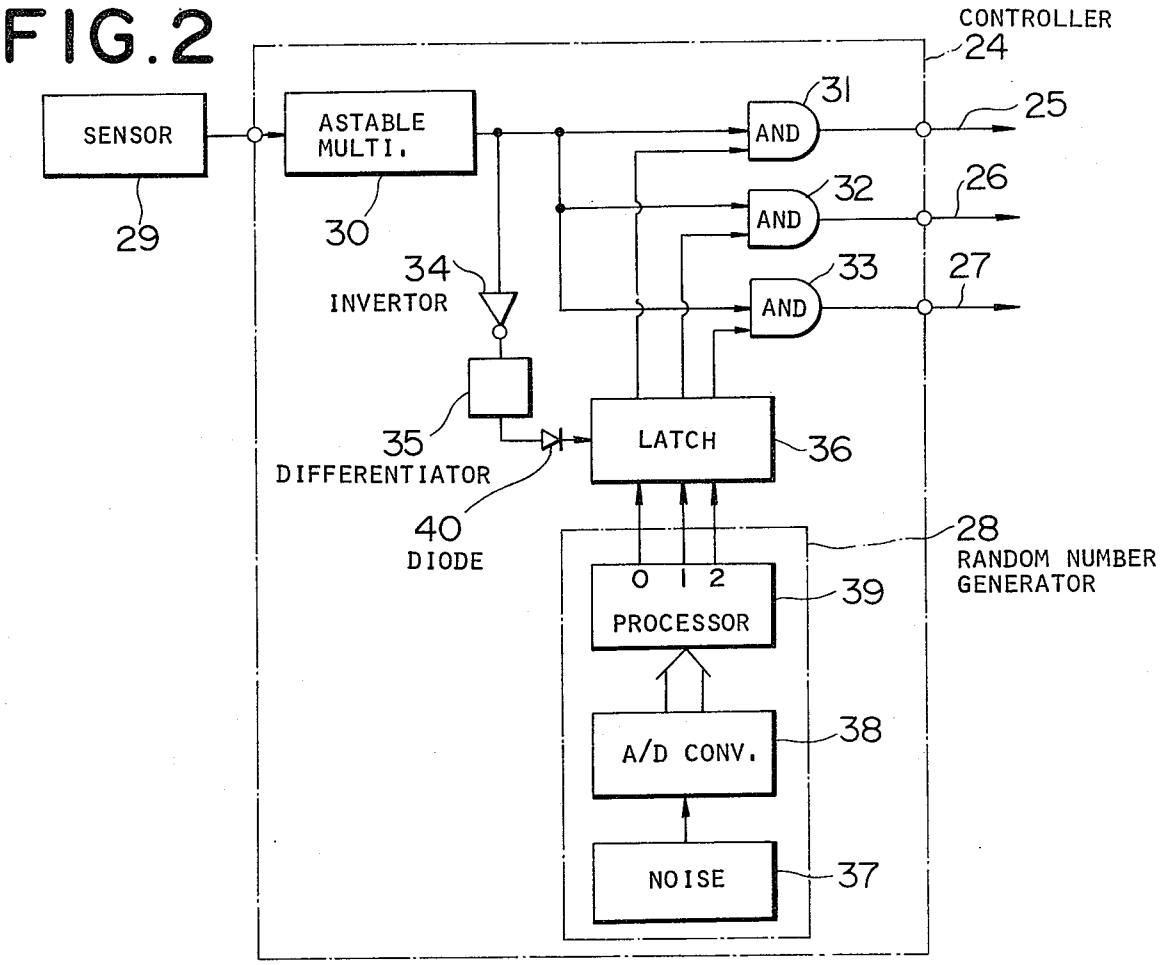
FIG. 2 is a diagrammatic view of the controller in FIG. 1.

As illustrated in FIG. 2, the controller 24 consists of an astable multivibrator 30, AND gates 31, 32 and 33, an invertor 34, a differentiator 35, a latch circuit 36, a diode 40, and the aforementioned random number generator 28, which includes a noise source 37, an analog-to-digital converter 38, and a processor or decoder 39. The noise source 37 creates electrical noise whose output voltage varies substantially at random, and delivers the output voltage to the analog-to-digital converter 38. The converter 38 changes the output voltage of the noise source 37 into a digital signal so that the number indicated by the digital signal is proportional to the output voltage of the noise source 37. The processor 39 receives the digital signal indicative of the output voltage of the noise source and transforms it into another digital signal. When the digital signal indicative of the output voltage of the noise source is 3 m in terms of decimal numeration where m is an arbitrary integer including zero, the processor 39 makes only the output terminal "0" a HIGH-level and the other output terminals "1" and "2" LOW-level. When the digital signal is a 3 m+1, the processor 39 makes only the output terminal "1" HIGH-level and the other output terminals "0" and "2" a LOW-level. When the digital signal is 3 m+2, the processor 39 makes only the output terminal "2" a HIGH-level and the other output terminals "0" and "1" a LOW-level. In the generator 28, thus any one of the output terminals "0", "1" and "2" of the processor 39 becomes a HIGH-level in a random sequence.

The astable multivibrator 30 is of the type producing a constant-frequency pulse train whose pulse-width can be varied with the voltage applied to the control terminal thereof. For example, the sensor 29 has a potentiometer driven by an accelerator pedal (not shown) to detect the degree of depression of the accelerator pedal as an indication of the engine required power. Usually, the output voltage of the sensor 29 is so designed as to be proportional to the degree of depression of the accelerator pedal. The output voltage of the sensor 29 is applied to the control terminal of the astable multivibrator 30 so that the pulse-width of the pulse train as a control signal will vary with the engine required power. The pulse train or the control signal produced by the astable multivibrator 30 is delivered to the first input-terminals of the AND gates 31, 32 and 33. The second input-terminals of the AND gates 31, 32 and 33 are connected to the output terminals "0", "1" and "2" of the processor 39 respectively, through the latch circuit 36. The output terminals of the AND gates 31, 32 and 33 are connected electrically to the aforementioned control valves 13, 14 and 15 respectively by means of the leads 25, 26 and 27. The control signal is also delivered to the invertor 34 to be inverted. The inverted control signal as an output signal of the invertor 34 is fed to the differentiator 35 to be differentiated so that a narrow-width pulse train will be obtained as an output signal of the differentiator 35 whose each pulse is outputted at a time corresponding to the trailing or negative-going edge of each pulse of the control signal produced by the astable multivibrator 30. The differentiator 35 also creates a negative pulse train synchronous with the leading edge of each pulse of the control signal. The output signal of the differentiator 35 is applied to the strobe input of the latch circuit 36 via the diode 40. The diode 40 removes the above negative pulse train but passes the above normal pulse train synchronous with the trailing edge of each pulse of the control signal. Thus, the latch circuit 36 holds the output signal of the processor 39 produced at a time corresponding to the trailing edge of a pulse of the control signal until a time corresponding to the trailing edge of a subsequent pulse of the control signal, while the latched processor 39 output signal fed to the AND gates 31, 32 and 33 varies (including unvaried cases) at random every time a control signal pulse terminates as a trailing edge. Therefore, any one of the AND gates 31, 32 and 33, associated with any one of the output terminals "0" to "2" of the processor 39 being at a HIGH-level, is kept open for a period from a time corresponding to the trailing edge of a pulse of the control signal to that of a subsequent pulse of the control signal, in order to supply therethrough a single pulse of the control signal, existing within the foregoing period, to the corresponding control valve 13, 14 or 15. Since the latched processor 39 output signal varies (including unvaried cases) at random, each pulse of the control signal produced by the astable multivibrator 30 is distributed to any one of the control valves 13, 14 and 15 in a random sequence.

Figure 3:
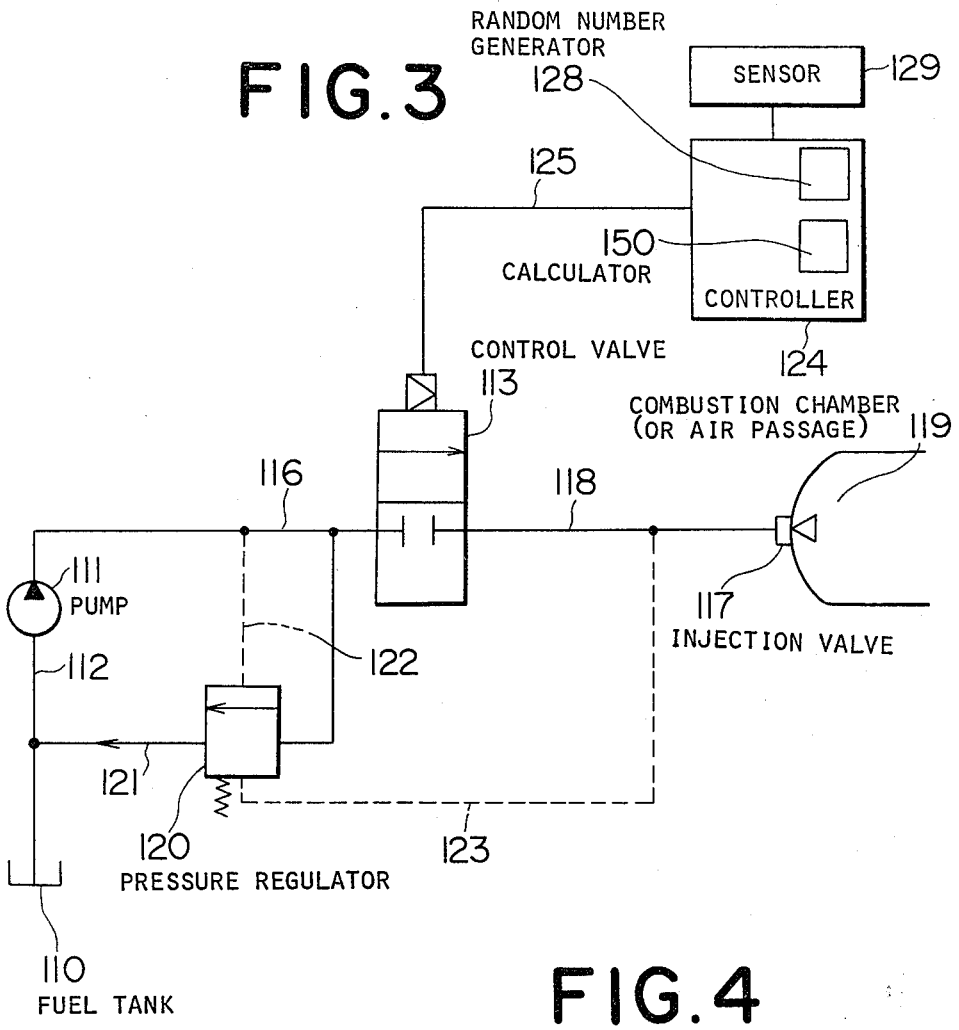
FIG. 3 is a diagrammatic view of a fuel-supply control system according to a second embodiment of the present invention.

In FIG. 3 is illustrated a fuel-supply control system for an engine according to a second embodiment of the present invention, having a fuel tank 110, a fuel-feed pump 111, a line 112, a control valve 113, a line 116, an injection valve 117, a line 118, an element 119, a pressure regulator 120, lines 121, 122 and 123, all of which are arranged in a similar manner to the corresponding parts of the aforementioned first embodiment except for the following points. There is only one control valve 113, so that the lines 116 and 118 have no branches and are single lines.

Figure 4:
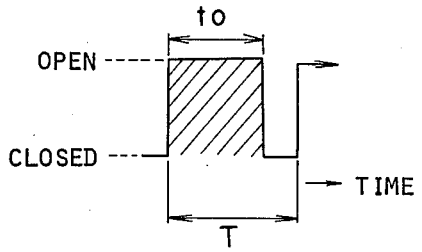
FIG. 4 is a timing chart of the opening and closing of the metering valve in FIG. 3 when the duty cycle of the control signal driving the metering valve is 0.75.

A controller 124 operates the control valve 113 by providing a drive signal to it through a lead 125. The controller 124 synthesizes a pulse-train control signal as a drive signal in response to an engine operating condition, such as the engine required power, the engine load, or the intake air flow rate, which is electrically detected by a sensor 129 designed in a similar manner to the corresponding sensor of the aforementioned first embodiment. Since the fuel pressure across the control valve 113 is kept constant by the pressure regulator 120, the amount of fuel injected per a unit time or the time-averaged fuel supply rate varies with the duty cycle of the control signal, which corresponds to the time ratio of the control valve 113 being opened. In general, while keeping the frequency of the control signal constant, the controller 124 changes the pulse-width of the control signal to vary the duty cycle thereof in response to the engine operating condition. When the duty cycle of the control signal to/T is 0.75, the control valve 113 is opened as shown in FIG. 4.

When the engine is operated under constant conditions, the control valve 113 opens at a constant frequency for an approximately constant period. In these conditions, the controller 124 in practice changes the pulse-width of the control signal very slightly at random, preferably within a tolerance. Thus, in fact, even under these constant engine operating conditions, since the open period of the control valve 113 (the period during which the valve opens) is changed at random within a small range, there exists no relatively large fuel pressure pulsations caused by interference between pressure pulsations each due to an opening of the control valve 113.

The controller 124 incorporates therein a random number generator 128 and a calculator 150. The generator 128 creates a digital number signal, which indicates at random any one of "0", "1", "2", "3", and "4" in terms of decimal numeration in synchronism with the control signal produced by the controller 124. The calculator 150 determines a modulated duty cycle of the control signal from the basic duty cycle responsive to the output signal from the sensor 129 indicative of the engine operating condition. In practice, the calculator 150 determines a modulated duty cycle by calculating $X+(Y/100)-(2/100)$, where X is the basic duty cycle; Y is an output digital signal number of the generator 128; and 2 corresponds the average value of the output numbers from the generator 128. For example, when the basic duty cycle remains 0.70, the modulated duty cycle is equal to any one of 0.68, 0.69, 0.70, 0.71, and 0.72 in random sequence since the output number from the generator 128 is any one of "0", "1", "2", "3", and "4" in random sequence. Thus the average modulated duty cycle is equal to the basic duty cycle. The controller 124 finally makes each pulse-width of the control signal correspond to the calculated duty cycle, and consequently the pulse-width changes at random within a small range even under constant engine operating conditions.

The generator 128 may creat a digital number signal indicating any one of "0" to "n" at random where n is a preset integer. In this case, the calculator 150 determines a modulated duty cycle by calculating $X+(Y/\alpha)-(n/2\alpha)$, where X is the basic duty cycle; Y is the output signal number from the generator 128; $\alpha$ is a preset constant determining the range of variation of the modulated duty cycle; and n/2 corresponds to the average value of the output numbers from the generator 128. In the second embodiment, $\alpha$ is 100 and n is 4.

Figure 5:
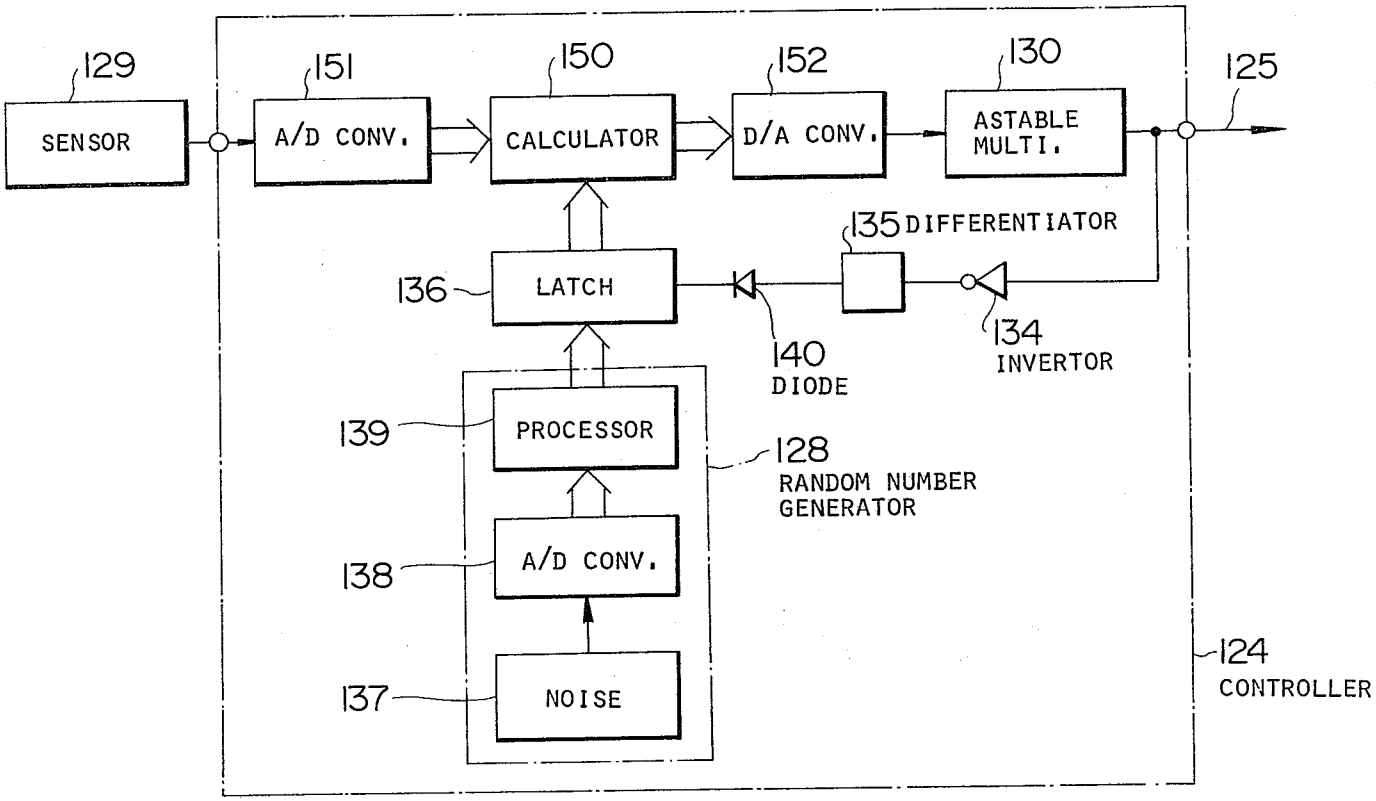
FIG. 5 is a diagrammatic view of the controller in FIG. 3.

As illustrated in FIG. 5, the controller 124 includes an analog-to-digital converter 151, which transforms the analog signal output from the sensor 129 to a corresponding digital signal indicative of the engine operating condition to obtain a basic duty cycle for the control signal. The calculator 150 consists of a digital processor determining a modulated duty cycle by calculating $X+(Y/100)-(2/100)$, where X is the basic duty cycle; and Y is the output digital signal number from the generator 128. The controller 124 also includes a digital-to-analog converter 152, which transforms the calculated duty cycle in digital form to a corresponding analog signal and applies the same to the control terminal of an astable multivibrator 130. The astable multivibrator 130 is of the variable pulse-width type, similarly to that of the aforementioned first embodiment, producing a constant-frequency pulse train fed to the control valve 113 through the lead 125 as a drive or control signal. Thus, each pulse-width of the control signal varies with the calculated duty cycle changing at random within a small range.

The generator 128 consists of a noise source 137, an analog-to-digital converter 138, and a processor or decoder 139, all of which are arranged in a similar manner to those of the aforementioned first embodiment except for the following point. In terms of decimal numeration, when the output signal of the converter 138 is 5 m, 5 m+1, 5 m+2, 5 m+3, or 5 m+4 where m is an arbitrary integer including zero, the processor 139 converts it to another digital signal "0", "1", "2", "3", or "4" respectively. Since the output voltage of the noise source 137 substantially varies at random, the converted signal is any one of "0", "1", "2", "3", and "4" in random sequence. The processor 139 feeds the converted signal to the calculator 150 as a random number signal through a latch circuit 136 incorporated into the controller 124. The output signal of the astable multivibrator 130 is also supplied to a differentiator 135 through an invertor 134, both incorporated into the controller 124, to obtain a narrow-width pulse train emanating every time a pulse of the control signal terminates as a trailing or negative-going edge. The narrow-width pulse train is applied to the strobe input terminal of the latch circuitry 136 through the diode 140, which cuts off a negative pulse train produced by the differentiator 135. Thus, the random number signal fed to the calculator 150 varies at random between "0", "1", "2", "3", and "4" (including unvaried cases) every time a pulse of the control signal terminates, and is held unchanged for a time from the trailing edge of a pulse to that of the subsequent pulse of the control signal.

It should be noted that all of the lines in the first and second embodiments of the present invention consist of conduits, hoses, passages, or the like. It should be understood that further modifications and variations may be made in the present invention without departing from the spirit and scope of the present invention as set forth in the appended claims.

What is claimed is:

1. A fuel supply control system for an engine comprising:

(a) a fuel supply line to supply fuel to the engine;

(b) at least two control valves arranged in the fuel supply line, the control valves being connected in parallel with each other and changing between open and closed states when energized by drive pulses;

(c) a sensor for detecting an engine operating condition and producing an output signal indicative thereof;

(d) a generator producing signals corresponding to a random designation sequence for designating the control valves in a random sequence, the number of the different signals equal to the number of the control valves; and (e) a controller responsive to the output signal of the sensor for generating said drive pulses, the duty cycle of the drive pulses variable with the engine operating condition, said controller operative for distributing each of said drive pulses to a random one of the control valves designated by the random designation signals of the generator to open the designated control valve so that the control valves are opened in a random sequence.

2. A fuel supply control system as defined in claim 1, wherein the fuel-supply line has parallel branches whose number is equal to that of the control valves, the control valves being arranged in each branch.

3. A fuel supply control system as defined in claim 2, wherein the lengths of the respective branches from the upstream ends thereof to the control valves are different from each other.

4. A fuel supply control system as defined in claim 2, wherein the lengths of the respective branches from the downstream ends thereof to the control valves are different from each other.

5. A fuel supply control system as defined in claim 1, further comprising a pressure regulator maintaining the fuel pressure across the control valves at a preset value, the control valves being all designed similarly, whereby when any one of the control valves is opened, the rate of fuel flow therethrough is kept constant irrespective of which control valve is opened.

6. A fuel supply control system as defined in claim 1, wherein the controller changes the pulse-width of the drive pulses while keeping the frequency of the drive pulses constant to vary the duty cycle thereof in response to the output signal of the sensor indicative of the engine operating condition.

7. A fuel supply control system as defined in claim 1, wherein the sensor detects the power required from the engine as the engine operating condition.

8. A fuel supply control system as defined in claim 1, wherein the sensor detects the engine loading as the engine operating condition.

9. A fuel supply control system as defined in claim 1, wherein the controller includes an astable multivibrator, having a control terminal and producing a constant-frequency pulse train as said drive signals, said pulse train having a pulse-width variable with the voltage applied to the control terminal thereof, the sensor outputting a voltage signal varying with the engine operating condition, the output voltage of the sensor being applied to the control terminal of the multivibrator so that the pulse-width of the pulse train varies with the engine operating condition.

10. A fuel supply control system as defined in claim 1, wherein the generator comprises a noise source having an analog output voltage which varies substantially at random, an analog-to-digital convertor transforming the output voltage of the noise source into a corresponding digital form, and a processor converting the digital form output from the analog-to-digital convertor to the random designation signals.

11. A fuel supply control system as defined in claim 10, the controller including an astable multivibrator having a control terminal and producing a constant-frequency pulse train as said drive signals said pulse train having a pulse-width variable with the voltage applied to the control terminal thereof, the sensor outputting a voltage signal varying with the engine operating condition, the output voltage of the sensor being applied to the control terminal of the multivibrator so that the pulse-width of the pulse train varies with the engine operating condition, the controller further including AND gates whose number is equal to that of the control valves, the pulse train produced by the multivibrator being fed to the first input terminal of each AND gate, the processor of the generator feeding the random designation signals to the second input terminals of the AND gates so that a random one of the AND gates is opened with the corresponding random designation signal, and output terminals of the AND gates being electrically connected to the corresponding control valves.

12. A fuel supply control system as defined in claim 11, wherein the controller further includes an invertor inverting the drive signal produced by the multivibrator, a differentiator differentiating the output signal of the invertor so as to produce a pulse train emanating at a time corresponding to the trailing edge of each pulse of the drive signal, and a latch circuit having a strobe input and storing the output signal of the generator and feeding the stored signal to the AND gates, the strobe input of the latch circuit being fed with a pulse train outputted by the differentiator.

13. A fuel supply control system for an engine comprising:

(a) a fuel supply line to supply fuel to the engine;

(b) a control valve arranged in the fuel supply line and changing between open and closed states when energized by drive signals;

(c) a sensor for detecting an engine operating condition and producing an output signal indicative thereof;

(d) a generator producing a random number signal indicative of any one of the integers 0 to n in a random sequence where n is a preset integer; and (e) a controller comprising;

(e-1) an astable multivibrator having a control terminal and producing a constant frequency pulse train as said drive signals for the control valve, the multivibrator changing the pulse width of said drive signals to vary the duty cycle thereof in response to a voltage applied to the control terminal thereof, and (e-2) a calculator determining a modulated duty cycle value for the drive signal by calculating $X+(Y/\alpha)-(n/2\alpha)$, where $\alpha$ is a preset constant; X is the basic duty cycle value corresponding to the output signal of the sensor indicative of the engine operating condition; and Y is the number indicated by the random number signal, the calculator feeding a voltage signal responsive to the modulated duty cycle value to the control terminal of the multivibrator so that the duty cycle of the drive signal is equal to the modulated duty cycle value so that each pulse width of the drive signal varies at random within a preset range even when the engine is operated under a constant condition.

14. A fuel supply control system as defined in claim 13, wherein the generator comprises a noise source having an analog output voltage which varies substantially at random, an analog-to-digital convertor transforming the output voltage of the noise source into a corresponding digital form, and a processor converting the digital form output from the analog-to-digital convertor to the random number signal indicative of any one of integers 0 to n.

15. A fuel supply control system as defined in claim 14, wherein the controller further comprising a second analog-to-digital convertor transforming the output signal of the sensor into a corresponding digital signal, the output signal of the second analog-to-digital convertor indicative of the engine operating condition being fed to the calculator, the calculator consisting of a digital processor, the controller further comprising a digital-to-analog convertor transformer the modulated duty cycle value determined by the calculator into a corresponding voltage signal, the voltage signal of the digital-to-analog convertor being fed to the control terminal of the multivibrator.

16. A fuel supply control system as defined in claim 15, wherein the controller further comprises an invertor inverting the drive signal produced by the multivibrator, a differentiator differentiating the output signal of the invertor so as to produce a pulse train emanating at a time corresponding the trailing edge of each pulse of the drive signal, and a latch circuit having a strobe input and storing the output signal of the processor of the generator and feeding the stored signal to the calculator, the strobe input of the latch circuit being fed with the pulse train outputted by the differentiator.

17. A fuel supply control system as defined in claim 13, wherein n is 4 and $\alpha$ is 100.

* * * * *